US008236472B2

(12) United States Patent
Fujisaki et al.

(10) Patent No.: US 8,236,472 B2
(45) Date of Patent: Aug. 7, 2012

(54) IMAGE FORMING METHOD

(75) Inventors: Tatsuya Fujisaki, Tokyo (JP); Kaori Soeda, Tokyo (JP); Shinya Obara, Tokyo (JP); Natsuko Kusaka, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 459 days.

(21) Appl. No.: 12/624,487

(22) Filed: Nov. 24, 2009

(65) Prior Publication Data

US 2010/0136476 A1 Jun. 3, 2010

(30) Foreign Application Priority Data

Dec. 1, 2008 (JP) ..... 2008-305835

(51) Int. Cl.
*G03G 13/24* (2006.01)

(52) U.S. Cl. ..... 430/124.1; 430/107.1; 430/108.8; 430/108.9; 430/123.5; 430/123.57

(58) Field of Classification Search ..... 430/107.1, 430/108.8, 108.9, 123.5, 124.1, 123.57
See application file for complete search history.

(56) References Cited

U.S. PATENT DOCUMENTS

| | | | | |
|---|---|---|---|---|
| 2,297,691 | A | 10/1942 | Carlson | |
| 7,045,265 | B2 * | 5/2006 | Horikoshi et al. | 430/108.6 |

FOREIGN PATENT DOCUMENTS

| | | |
|---|---|---|
| JP | 2004133247 | 4/2004 |
| JP | 2006227308 | 8/2006 |
| JP | 2007034264 | 2/2007 |
| JP | 2007140478 | 6/2007 |

* cited by examiner

*Primary Examiner* — Thorl Chea
(74) *Attorney, Agent, or Firm* — Lucas & Mercanti, LLP

(57) ABSTRACT

Provided is a method for forming an image with a set of electrostatic charge image developing toners using a digital electrophotographic method, provided that the set of electrostatic charge image developing toners comprises a black toner and a light gray toner, the method comprising the steps of: forming an electrostatic latent image on an image support; developing the electrostatic latent image with the black toner to form a black toner image; developing the electrostatic latent image with the light gray toner to form a light gray toner image; and fixing the black toner image and the light gray toner image, wherein the black toner and the light gray toner each independently contains a wax having an endothermic peak in the range of 60 to 105° C.; and the light gray toner has a transmittance in the range of 40 to 90%.

7 Claims, 1 Drawing Sheet

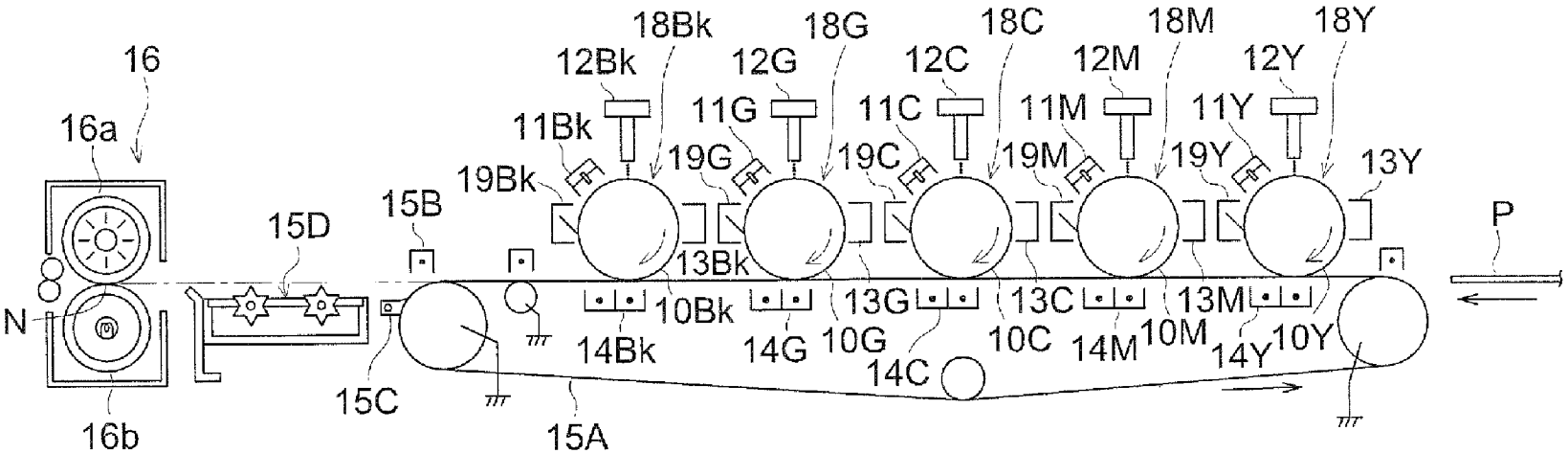
P
18Y
13Y
12Y
11Y
19Y
10Y
14Y
13M
18M
12M
11M
19M
10M
14M
13C
18C
12C
11C
19C
10C
14C
13G
18G
12G
11G
19G
10G
14G
13Bk
18Bk
12Bk
11Bk
19Bk
10Bk
14Bk
15A
15B
15C
15D
16
16a
16b
N

IMAGE FORMING METHOD

CROSS REFERENCE TO RELATED APPLICATION

This application is based on Japanese Patent Application No. 2008-305835 filed on. Dec. 1, 2008 with Japan Patent Office, the entire content of which is hereby incorporated by reference.

TECHNICAL FIELD

The present invention relates to an image forming method by an electrostatic printing process (it is also called as an electrophotographic process).

BACKGROUND

In an image forming method by an electro photographic process, an image is generally formed by the following steps: forming an electrostatic latent image on an electrostatic latent image carrier; developing the electrostatic latent image with a toner to obtain a toner image; transferring this toner image to an intermediate transfer member; then again transferring the transferred toner on the intermediate transfer member to an image forming support, such as paper; and fixing the image on the image forming support to form a final fixed toner image (for example, refer to Patent Document 1).

In an image forming method of a digital mode, in order to from of an electrostatic latent image, light exposure is performed, for example, by pulse modulated dots, and reversal development is carried out by allowing the toner to adhere on the portion applied the dots (the dot portion). The amount of the toner adhering to the dot portion is determined according to the area of the dot portion on an electrostatic latent image carrier, the state of an electric potential on an electrostatic latent image carrier, the developing bias to the dot portion and the state of the electric charge possessed by the toner. A high density image portion which is recorded on an electrostatic latent image carrier by a light exposure device has a large number of dots per unit area and the size of one dot is large. On the other hand, A low density image portion has a small number of dots per unit area and the size of one dot is small. As a result, a high density image portion on an electrostatic latent image carrier has a large toner adhesion amount after development, while a low density image portion has a small toner adhesion amount. Thus, the difference between a high and a low density image is expressed by the toner adhesion amount per unit area which adhered on an electrostatic latent image carrier. By this reason, there is a problem that a low density image portion (it is also referred to as "a highlight portion") tends to have a deteriorated granularity, and as a consequence, there is a problem that a stable gradation is hard to obtain. Here, "deteriorated granularity" indicates the state that gives a feeling of detailed roughness of light and shade and an inhomogeneous feeling which are visually recognized in the highlight portion homogeneously exposed.

In order to resolve such a problem, there is disclosed a technology which enables to perform an image formation excellent in granularity even in a highlight portion by using a gray toner (for example, refer to the Patent Document 2 and Patent Document 3.)

However, even when a gray toner is used, since glossiness of an image formed by an electrophotographic process is controlled by the toner image composed mainly of a binder resin and a colorant and also by the surface smoothness of the wax layer which bled out on the toner image, a high density image portion having a high toner adhesion amount (it is also referred to "a shadow portion") tends to have a high glossiness, while a highlight portion having a remarkably small toner adhesion amount tends to have a glossiness which depends on the image forming support background. The difference of glossiness between a shadow portion and a highlight portion has been an obstacle to improve the image quality.

On the other hand, to the photographic image produced by a color image forming method, the colorfulness of color is required and development of new coloring materials for a color toner is progressing (for example, refer to Patent Document 4 and Patent Documents 5.) In these developments, although it became possible to increase chroma and lightness of a color toner, there occurred the following problem.

The problem is a difficult reproduction of a soft tone image and a soft tone image. A soft tone and a soft tone are a mixed color located between a vivid tone (pure color) and a dark grayish tone (shade, a color obtained by adding black to a pure color). A vivid tone has a high chroma and a high lightness, one the other hand a dark grayish tone has a low chroma and a low lightness. A light tone (tint, a color obtained by adding white to a pure color) is produced by decreasing an image area ratio of a vivid tone. And a soft tone is a color produce by adding a small amount of darkness to a light tone. A dull tone is a color by adding a more amount of darkness to a light tone than a soft tone. In addition, a dark tone is a color produced by further adding darkness to a dull tone.

"A soft tone" gives a feeling of soft and familiar, therefore it is used for a wide range of application. "A dull tone" gives a feeling of heavy and quiet, therefore it is used for a fashion or an interior color.

The catalogue which shows product images are required a faithful color reproduction, because, a subtle difference of color between the print and the real object will change the total impression. Therefore, it is required a specific toner which enables to control the chroma and lightness of a color toner.

Examples of "a soft tone" expressed in color code used to indicate colors in a Web page include: #e09696, #e0ce96, #bbe096, #96e0a9, #96e0e0, #96a9e0, #bb96e0, #e096ce, #cc7a7a, #cc967a, #ccb17a, #cccc7a, #b1cc7a, #96cc7a, #7acc7a, #7acc96, #7accb1, #7acccc, #7ab1cc, #7a96cc, #7a7acc, #967acc, #b17acc, #cc7acc, #cc7ab1 and #cc7a96.

Examples of "a dull tone" expressed in color code include: #b35959, #b37759, #b39559, #b2b359, #95b359, #77b359, #59b359, #59b377, #59b395, #59b3b3, #5995b3, #5977b3, #5959b3, #7759b3, #9559b3, #b259b3, #b35995, #b35977, #8c3f3f, #8c663f, #8c8c3f, #668c3f, #3f8c3f, #3f8c66, #3f8c8c, #3f668c, #3f3f8c, #663f8c, #8c3f8c, #8c3f66, #996666, #999966, #669966, #669999, #666699 and #996699.

Patent Document 1: U.S. Pat. No. 2,297,691

Patent Document 2: Japanese Patent Application Publication (JP-A) No. 2004-133247

Patent Document 3: JP-A No. 2006-227308

Patent Document 4: JP-A No. 2007-140478

Patent Document 5: JP-A No. 2007-34264

SUMMARY

The present invention was achieved based on the above described situation. An object of the present invention is to provide an image forming method which enables to produce a high quality image of: showing only a small amount of difference of glossiness between a highlight portion and a shadow portion; exhibiting uniform and three-dimensional feeling, and further to provide an image forming method enabling to produce an image excellent in granularity even when a soft tone image and a dull tone image are produced.

The present invention was achieved by the following embodiments.

An aspect of the present invention is a method for forming an image with a set of electrostatic charge image developing toners (it is simply called as a "toner") using a digital electrophotographic method, provided that the set of electrostatic charge image developing toners comprises a black toner and a light gray toner, and the black toner and the light gray toner each comprise toner particles containing a binder resin, a colorant and a releasing agent.

The method is characterized by comprising the steps of:

forming an electrostatic latent image on an image support;

developing the electrostatic latent image with the black toner, wherein the black toner contains a wax having an endothermic peak in the range of 60 to 105° C.; and developing the electrostatic latent image with the light gray toner, wherein the light gray toner has a transmittance in the range of 40 to 90%, provided that the transmittance is measured for an image portion formed on a polyethyleneterephthalate sheet with an adhesion amount of the light gray toner of 4.0 g/m$^2$, and the light gray toner contains a wax having an endothermic peak in the range of 60 to 105° C.

In another aspect of the method for forming an image of the present invention, it is preferable that the step of developing the electrostatic latent image with the light gray toner is carried out before the step of developing the electrostatic latent image with the black toner.

In another aspect of the method for forming an image of the present invention, it is preferable that each of the toners in the set of electrostatic charge image developing toners has a softening point of 70 to 120° C.

In another aspect of the method for forming an image of the present invention, it is preferable that the method further comprising the step of:

developing the electrostatic latent image with a color toner comprising at least one of a yellow toner, a cyan toner and a magenta toner, wherein the step of developing the electrostatic latent image with the light gray toner is carried out in a manner that an image formed with the light gray toner is provided on an image formed with the color toner on the image support.

In another aspect of the method for forming an image of the present invention, it is preferable that the colorant contained in the yellow toner is C. I. Pigment Yellow 74. It is preferable that the colorant contained in the cyan toner contains a silicon phthalocyanine compound represented by Formula (1). And, it is preferable that the colorant contained in the magenta toner comprises toner a compound represented by Formula (3).

Formula (1)

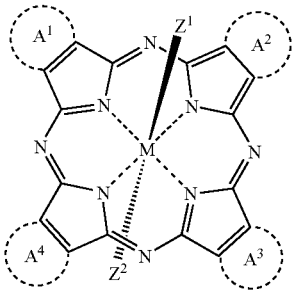

In Formula (1), M represents a silicon atom; $A^1$ to $A^4$ each independently represents a group of atoms which form a benzene ring or a group of atoms which form a benzene ring substituted with at least one of a chlorine atom, a nitro group, a cyano group and a perfluoro group; and $Z^1$ and $Z^2$ each independently represents a hydroxyl group, a chlorine atom, an aryloxy group having 6 to 18 carbon atoms, an alkoxy group having 1 to 22 carbon atoms or a group represented by Formula (2):

$$—O—Si(R^1)(R^2)(R^3).$$

In Formula (2), $R^1$ to $R^3$ each independently represents an alkyl group having 1 to 6 carbon atoms, an aryl group having 6 to 18 carbon atoms, an alkoxy group having 1 to 6 carbon atoms or an aryloxy group having 6 to 18 carbon atoms.

Formula (3)

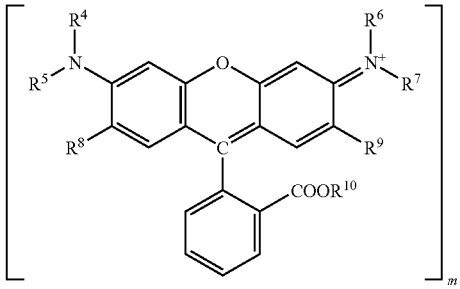

In Formula (3), $R^4$ to $R^{10}$ each independently represents a hydrogen atom or an alkyl group having 1 to 6 carbon atoms; $A^-$ represents a chlorine ion, a carboxylic acid ion having 1 to 22 carbon atoms or an atomic group represented by one of Formulas (4) to (6); and "m" represents an integer of 1 or 2.

Formulas (4)

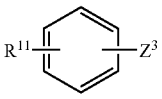

Formulas (5)

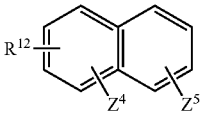

Formulas (6)

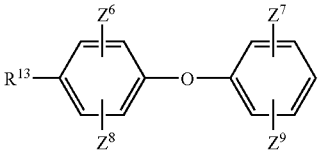

In Formula (4) to Formula (6), $R^{11}$ to $R^{13}$ each independently represents an alkyl group having 1 to 20 carbon atoms; $Z^3$ represents a $—SO_3^-$ group, $Z^4$ and $Z^9$ each independently represents a hydrogen atom, an alkyl group or a $—SO_3^-$ group, provided that one of $Z^4$ and $Z^5$, and one of $Z^6$ to $Z^9$ represents a $—SO_3^-$ group.

According to the image forming method of the present invention, by performing the developing process with at least a black toner and a light gray toner which has a specific composition, a highlight portion is formed with a light gray toner instead of with a black toner. Therefore, compared with the case where the highlight portion is formed with a black toner, a dot number per unit area becomes large in the highlight portion, and the size of 1 dot also becomes large. That is, in a highlight portion, by increasing the toner adhesion amount per unit area compared with the case where it is formed with a black toner, the difference of the toner adhesion amount between the highlight portion and the image portion formed with a black toner becomes small. Furthermore, since the amount of bleeding of the wax contained in the toner will be increased, glossiness of the highlight portion can be made high. Therefore, the obtained image has a small difference of glossiness between, a highlight portion and a shadow portion and the obtained image is uniform and gives a three-dimensional feeling. And an image excellent in granularity can be obtained when a soft tone image and a dull tome image are produced.

Furthermore, according to the image forming method of the present invention, an image is formed by superimposing a light gray toner image on a color toner image, and the transmittance of the image portion formed on a PET sheet by a light gray toner is controlled to be in is a specific rang. By this since an image formation is done by moderately darkening an underlying color toner image, the ability of expression of an image can be increased and a high quality image can be produced even when a soft tone image and a dull tone are formed.

BRIEF DESCRIPTION OF THE DRAWING

FIG. 1 is an illustrative cross sectional view showing one of the examples of an image forming apparatus used in the image forming method of the present invention.

DESCRIPTION OF THE PREFERRED EMBODIMENT

Hereafter, the present invention is described in detail.

<Light Gray Toner>

A light gray toner used in the image forming method according to the present invention contains toner particles having a binder resin, a colorant and a releasing agent. A light gray toner of the present invention is also called as "a specific light gray toner".

In addition, a specific light gray toner of the present invention has a transmittance in the range of 40 to 90%, provided that the transmittance is measured for an image portion formed on a polyethyleneterephthalate (PET) sheet with an adhesion amount of the light gray toner of 4.0 g/m$^2$. Further, the aforesaid light gray toner contains a wax having an endothermic peak in the range of 60 to 105° C.

The light gray toner and the black toner of the present invention each are an achromatic toner which is required to satisfy the following relationship in a*b* color space for the hue of the image having a toner adhesion amount of 4.0 g/m$^2$.

$$\text{Relationship}: \{(a^*)^2+(b^*)^2\}^{1/2} \leqq 5$$

The aforesaid "a*" and "b*" can be measured as follows. The transferring paper having a grammage of 128 g/m$^2$ and a lightness of 93, for example, "POD gloss coat paper" made by Oji Paper Co. Ltd is used. The measurement is carried out using a spectrophotometer "GretagMacbeth Spectrolino" (made by Gretag Macbeth Corporation) with a light source of D65, and a reflection measurement aperture of Φ4 mm. In the range of wavelength is 380 to 730 nm, each point having an interval of 10 nm is measured with a viewing angle of 2°. A specific white tile is used for as a reference for standardizing.

[Transmittance]

The transmittance of the image formed on a PET sheet can be determined by the following process:

by using a spectrophotometer "U-3500" (made by Hitachi High-Tech Fielding Corporation), a visible wavelength spectral transmittance of a PET sheet having no toner thereon is measured as a reference and a spectral transmittance at a wavelength of 600 nm is obtained;

then, a fixed light gray toner image formed on a PET sheet with an adhered amount of the light gray toner of 4.0 g/m$^2$ was subjected to the same measurement as the reference to obtain a spectral transmittance at a wavelength of 600 nm;

The "transmittance" in the present invention is defined as a relative value of a spectral transmittance of an image formed on a PET sheet in relation to a spectral transmittance of a reference. The spectral transmittance of a reference is set to be 100%.

The toner image formation is carried out by using a commercially available multifunction peripheral "bizhub PRO C6500" (made by Konica Minolta Business Technologies Inc.) A toner adhesion amount is a value obtained as follows: a non fixed toner image is formed a PET sheet; the toner is blown off from the PET sheet; a value is obtained by dividing the mass difference before and after blowing off with an amount of the image area. When it is difficult to take a sample of a PET sheet having an unfixed image, due to the structure of the image forming device, the toner adhesion amount can be obtained by dividing the mass difference before and after removing the fixed image on the PET sheet with a solvent with an amount of the image area. An example of a solvent used to remove the fixed image is a solvent such as methyl ethyl ketone which does not dissolve a PET sheet.

Here, the PET sheet employed to determine the value of transmittance has a thickness of 0.1 μm, and it is not subjected to a roughening process or a coating treatment. Specifically, a sheet of "3M Transparency Film PP250, A4 size" (made by Sumitomo 3M Ltd.) is used for this measurement.

In the image forming method of the present invention, a transmittance of an image portion formed with the specific light gray toner on a PET sheet with an adhered amount of 4.0 g/m$^2$ is in the range of 40 to 90%. It is preferably from 60 to 85%.

By setting the transmittance of an image portion formed with the specific light gray toner to be in the above described range, it is possible to produce a final image suitably darkened the underlying color image when the final image is formed in such a manner that a light gray image is superimposed on a color toner image. As a result, both a soft tone image and a dull tone image can exhibit improved expression ability and can produce a high quality image.

It is preferable that the color toner dots and the specific light gray toner dots are superimposed in an amount of 5 to 50 of the formed image area when a soft tone image and a dull tone image are produced. However, even when the color toner dots and the specific light gray toner dots are not superimposed but are located adjacently with each other, it can be produced an image having a decreased roughness of light and shade and an improved granularity compared with an image produced with the black toner dots.

Here, a preferable way of usage of a light gray toner of the present invention will be described below.

When a maximum developing electric potential of a black toner is Vmax:

(i) dot latent images having an electric potential in the range of (1/256)×Vmax and (1/4)×Vmax are developed only by a light gray toner, (ii) dot latent images having an electric potential in the range of (1/4)×Vmax and (1/2)×Vmax are developed both by a light gray toner and a black toner, an adhering amount of a light gray toner is controlled to be larger than adhering amount of a black toner with reference to a table, (iii) dot latent images having an electric potential larger than (½)× Vmax are developed only by a black toner.

Vmax is a difference between a developing bias electric potential applied to a developing roller and an electric potential of a photoreceptor at a maximum exposure.

The light gray toner of the present invention may be used for a monochrome image which is conventionally formed by a black toner. However, it is more preferable to use for the image formed by superimposed dots of yellow, magenta and cyan and can be replaced with a black toner. As described above, it is preferable to use both a light gray toner and a black toner for the superimposed image by making sharing the amount in according to the dot electric potentials.

[Releasing Agent]

A wax is used as the aforesaid releasing agent. Specific examples of a wax include: an aliphatic hydrocarbon wax such as a paraffin wax, a polyethylene wax, an oxidized polyethylene wax, a polypropylene wax; and an ester wax such as a montan wax, a carnauba wax, a rice wax, a chandelier wax. It may be possible to use a plurality of waxes by combining two or more of them.

A content ratio of a releasing agent contained in the specific light gray toner of the present invention is from 2 to 25 weight part with respect to a 100 weight part of a binder resin. Preferably, it is from 6 to 18 weight part. When the content ratio of a releasing agent is less than 2 weight part, it becomes difficult to compensate the glossiness difference between the highlight portion and the shadow portion by using the light gray toner. On the other hand, when the content ratio of a releasing agent is more than 25 weight part, there may be produced separated particles of the releasing agent which cannot be incorporated in the toner particles. These separated particles may produce a film on a photoreceptor or on an intermediate transfer member and may induce an image defect.

[Melting Point of a Releasing Agent]

A melting point of a releasing agent is defined as a top temperature in an endothermic peak. It can be measured with a differential scanning colorimeter "DSC-7" (made by Perkin Elmer Co. Ltd.) and a thermoanalysis controller "TAC7/DX" (made by Perkin Elmer Co. Ltd.).

A specific measuring method is as follows. In a pan made of aluminium (KIT No. 0219-0041) is placed 4.5 mg of a sample and is sealed. Then the pan is set in a sample holder of DSC-7, and it is subjected to a temperature cycle of Heating-Cooling-Heating under the conditions of: a measuring temperature of 0 to 200° C.; a temperature rising rate of 10° C./minute; and a temperature falling rate of 10° C./minute. This measurement is repeated twice. The data obtained from the second measurement is used for analysis. An empty pan made of aluminum is used as a reference measurement.

An endothermic peak of the releasing agent (a wax) contained in the specific light gray toner used in the image forming method of the present invention is preferably from 60 to 105° C. More preferably, it is from 70 to 97° C.

When the endothermic peak of the releasing agent is less than 60° C., since the melting point of the releasing agent is too low, an amount of the wax bled out on the surface of a toner image becomes so large that the shadow portion of the image having a large toner adhesion amount will have an increased glossiness. As a result, there is a possibility that it may become difficult to form a uniform image with a small difference in glossiness in the image. On the other hand, when the endothermic peak of the releasing agent is more than 105° C., since the melting point of the releasing agent is too high, an amount of the wax bled out on the surface of a toner image becomes so small that that the highlight portion of the image having a small toner adhesion amount will have a decreased glossiness. As a result, there is a possibility that it may become difficult to form a uniform image with a small difference in glossiness in the image.

[Binder Resin]

As a binder resin contained in the specific light gray toner of the present invention, the following publicly known resins can be used when the toner particles are prepared with a pulverization method or a dissolution suspension method. Examples of a binder resin include: a vinyl resin such as a styrene resin, a (metha)acrylic resin, a styrene-(metha)acrylic copolymer resin and an olefin resin; and further, a polyester resin, a polyamide resin, a polycarbonate resin, a polyether resin, a vinyl acetate resin, a polysulfone resin, an epoxy resin, a polyurethane resin and a urea resin.

When the toner particles are prepared with a suspension polymerization method, a mini-emulsion polymerization aggregation method or an emulsion polymerization aggregation method, a various known polymerizable monomer such as a vinyl monomer can be used for preparing a various kinds of resins which constitute the toner particles. It is preferable that a polymerizable monomer containing an ionic-dissociative group in the molecule is used in combination with the aforesaid monomer. Further, a multifunctional vinyl monomer can be used as a polymerizable monomer to obtain a cross-linkable binder resin.

[Colorant]

When a carbon black is used as a colorant contained in the specific light gray toner of the present invention, a content of the carbon black is preferably from 0.03 to 2.0 weight part with respect to a 100 weight part of a binder resin from the viewpoint of controlling the transmittance of the image portion made by the light gray toner. A specifically preferable content of the carbon black is from 0.03 to 0.54 weight part.

It is possible to use a black dye as a colorant contained in the specific light gray toner of the present invention. When a black dye is used as a colorant, the colorant is dissolved in the binder resin and transparency of the toner particles will be increased. Consequently, in order to obtain the same transparency as a carbon black, a content of the black dye is preferably from 0.08 to 0.42 weight part with respect to a 100 weight part of a binder resin.

Preferable examples of a black dye include: C. I. Direct Black (hereafter, it is referred to "DBk")-19, DBk-38, DBk-71, DBk-74, DBk-75, DBk-90, DBk-112, DBk-117 and DBk-154; and Acid Black (hereafter, it is referred to "ABk")-2, ABk-24, ABk-31 and ABk-52.

Further, a white pigment such as titanium oxide can be used as a colorant of a light gray toner in combination with other colorant. Since a white pigment cannot easily control the transmittance, preferable content of the white pigment is less than 2 weight part with respect to a 100 weight part of a binder resin.

<Black Toner>

The image forming method of the present invention contains a developing step using a black toner comprising toner particles containing a binder resin, a colorant and a releasing agent. A wax having an endothermic peak of 60 to 105° C. is used as a releasing agent.

Here, the black toner of the present invention is a toner having a transmittance in the range of 0 to 20%, provided that the transmittance is measured for an image portion formed on a PET sheet with an adhesion amount of the black toner of 4.0 g/m$^2$.

As a black colorant contained in a black toner of the present invention, a carbon black, a black dye composed of an azine, an acid black dye and iron oxide can be used. Specifically, iron oxide is preferably used. A content of a black colorant is preferably from 0.04 to 0.38 weight part with respect to a 100 weight part of a binder resin. More preferably, it is from 0.08 to 0.30 weight part.

<Yellow Toner>

The yellow toner of the present invention contains toner particles having a binder resin, a colorant and a releasing agent. Examples of a yellow colorant include: C. I. Pigment Yellow 74, C. I. Pigment Yellow 3, C. I. Pigment Yellow 35, C. I. Pigment Yellow 65, C. I. Pigment Yellow 93, C. I. Pigment Yellow 98, C. I. Pigment Yellow 111, C. I. Pigment Yellow 139, C. I. Solvent Yellow 94 and C. I. Solvent Yellow 162. Among them, C. I. Pigment Yellow 74 is most preferably used.

It is preferable that a content of a yellow colorant is from 3 to 10 weight part with respect to a 100 weight part of a binder resin.

<Cyan Colorant>

The cyan toner of the present invention contains toner particles having a binder resin, a colorant and a releasing agent. As a cyan colorant, it is preferable to contain a silicon phthalocyanine compound represented by the aforesaid Formula (1). The silicon phthalocyanine compound represented by the aforesaid Formula (1) has a higher lightness than the conventionally used cooper phthalocyanine compounds and it is excellent in coloring of green. Further, by combing a cyan toner containing a silicon phthalocyanine compound represented by Formula (1) and a specific light gray toner, the ability of expression of a soft tone image and a dull tone image is increased, which results in producing an image of high quality.

Specific examples of a silicon phthalocyanine compound represented by Formula (1) are compounds represented by Formula (1-1) or Formula (1-2). In particular, a silicon phthalocyanine compound represented by Formula (1-2) is most preferably used.

It is preferable that a content of a cyan colorant is from 2 to 9 weight part with respect to a 100 weight part of a binder resin, and more preferably it is from 3 to 7 weight part.

Formula (1-1)

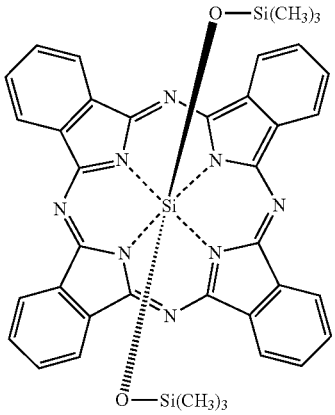

-continued

Formula (1-2)

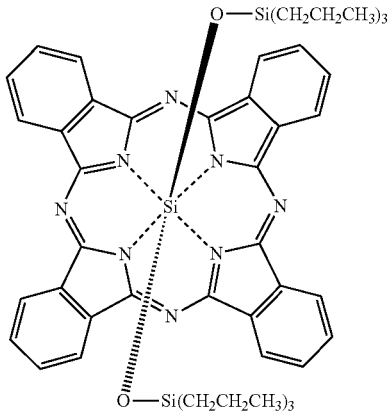

<Magenta Colorant>

The magenta toner of the present invention contains toner particles having a binder resin, a colorant and a releasing agent. As a magenta colorant, it is preferable to contain a compound represented by the aforesaid Formula (3). The compound represented by the aforesaid Formula (3) has a superior ability of expression in a vivid tone to the conventionally used magenta organic pigments. Further, by combing a magenta toner containing a compound represented by Formula (3) and a specific light gray toner, the ability of expression of a soft tone image and a dull tone image is increased, which results in producing an image of high quality.

Specific examples of a compound represented by the aforesaid Formula (3) are compounds represented by Formula (3-1) or Formula (3-2). In particular, a compound represented by Formula (3-2) is most preferably used.

It is preferable that a content of a magenta colorant is from 3 to 12 weight part with respect to a 100 weight part of a binder resin, and more preferably it is from 4 to 8 weight part.

Formula (3-1)

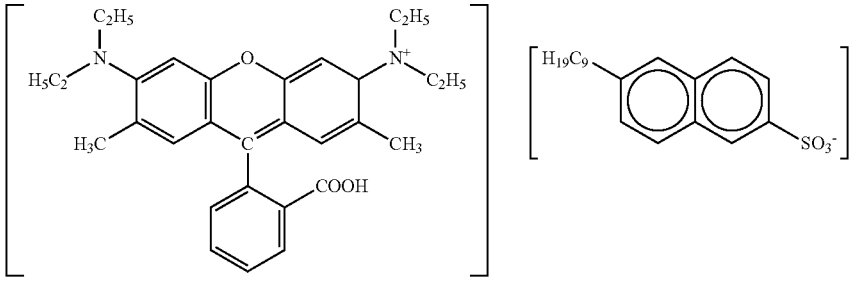

-continued

Formula (3-2)

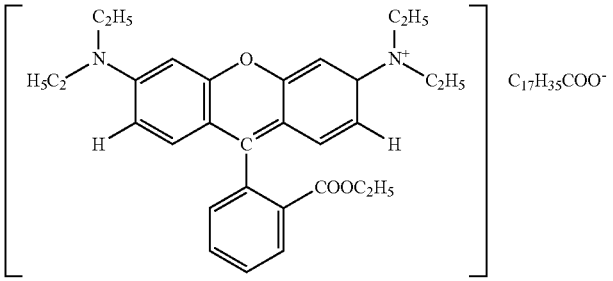

Regarding to the binder resin and the releasing agent contained in each of the black toner, the yellow toner, the cyan toner and the magenta toner, the same binder resin and the same releasing agent as used in the aforesaid light gray toner can be used.

<Softening Point>

The toner used in the image forming method of the present invention preferably has a softening point from 70 to 120° C., more preferably from 80 to 110° C. By adjusting the softening point of the toner to be in the aforesaid range, a suitable melted condition of the toner is acquired in the fixing step and an image achieving high color reproduction can be obtained. When the toner having the softening point of less than 70° C. is used, the image produced by superimposing a plurality of toner images may have a mixture of colors because the interface formed by the binder resin contained in each toner will be disappeared. On the other hand, when the toner having the softening point of more than 120° C. is used, the melting of the toner in the fixing step may not be suitable proceeded. This will produce the case in which the dye and the pigment contained in the colorant are not uniformly dispersed, and as a result, an image of high color reproduction may not be obtained.

<Manufacturing Method of Toner>

Manufacturing methods of the toner used in the image forming method of the present invention include: a kneading-pulverization method, a suspension polymerization method, an emulsion polymerization method, an emulsion polymerization aggregation method, a mini-emulsion polymerization aggregation method, an encapsulating method, as well as other conventional methods. Of these, by considering the requirement to obtain small sized tone particles to achieve an image of high quality, an emulsion polymerization aggregation method is preferably used from the viewpoints of a manufacturing cost and a manufacturing stability.

An emulsion polymerization aggregation method contains the following steps of:

preparing a dispersion of microparticles of a binder resin which is prepared with an emulsion polymerization method. These micro particles are called as "binder resin microparticles";

mixing the binder resin microparticles with microparticles of a colorant (it is called as "colorant microparticles");

allowing to slowly aggregate the binder resin microparticles and the colorant microparticles by taking a balance of a repulsion force of the surface of microparticles by adjusting a pH value and an aggregation force caused by an addition of an aggregating agent composed of an electrolyte.

During the aggregation of the aforesaid microparticles, an average particle size and particle distribution are controlled, and at the same time, by stirring with applying heat, fusion of the microparticles is performed to achieve a shape control. By the aforesaid steps, toner particles by the emulsion polymerization aggregation method can be produced.

In the manufacturing method of the toner of the present invention, the binder resin microparticles which are prepared using an emulsion polymerization aggregation method may have a plurality of binder resin layers. In that case, it may be possible to adopt the following method. That is, to prepare a dispersion of particles of a first resin produced by a conventional emulsion polymerization method (a first step polymerization), and then to add a polymerization initiator and a polymerizable polymer to the aforesaid dispersion of particles of a first resin so as to polymerize this system (a second step polymerization).

A manufacturing method of toner particles having a core-shell structure is as follows. At first, core forming binder resin microparticles and colorant microparticles are allowed to associate, to aggregate and to fuse so as to form core particles. Then, to a dispersion of the core particles are added shell forming resin particles so as to form a shell layer. The shell layers are formed by aggregating and by fusing the shell forming resin particles on the surface of the aforesaid core particles.

The shape of a core particle which forms a toner particle having a core-shell structure can be controlled by adjusting the heating temperature during the aggregation-fusion step and by adjusting the heating temperature and the heating time of the first ripening step. In particular, by controlling the heating time of the first ripening step, a circularity of associated particles can be reliably adjusted.

The core particles are preferably formed as follows: mechanically dispersing a polymerizable monomer which forms a core forming resin of the aforesaid core particles in an aqueous medium; producing core forming resin microparticles by a mini-emulsion polymerization method; and salting out and fusing the core forming resin microparticles with colorant microparticles by a salting out-fusion method.

The toner particles having a core-shell structure and used in the image forming method of the present invention can be produced by the following method containing the steps as described below:

(1) a step of preparing a dispersion of colorant microparticles: to prepare a dispersion of colorant microparticles in which a colorant is dispersed in microparticles, (2-1) a step of polymerizing core forming binder resin microparticles: to prepare core forming binder resin microparticles containing a releasing agent, a charge controlling agent and a core binder resin, and then to prepare a dispersion of the core forming binder resin microparticles, (2-2) a step of polymerizing shell forming resin microparticles: to prepare resin microparticles composed of a shell forming resin, and then to prepare a dispersion of the shell forming resin microparticles, (3) a step of aggregation-fusion: to prepare associated particles which should form core particles by aggregating and fusing the core forming binder resin microparticles with the colorant microparticles in an aqueous medium, (4) a first ripening step: to obtain the core particles by ripening the associated particles with heating energy so as to control the shape of the core particles, (5) a shell layer forming step: to add the shell forming resin microparticles in a dispersion of the core particles so as to form particles having a core-shell structure by aggregating and by fusing the shell forming resin microparticles on the surface of the core particles, (6) a second ripening step: to prepare colored particles having a core-shell structure by ripening the particles having a core-shell structure with heat energy and to control the shape of the colored particles, (7) a step of filtering and washing: to separate the colored particles from a dispersion system (an aqueous medium) and to eliminate a surface active agent and others from the colored particles by washing, (8) a step of drying: to dry the colored particles subjected to a washing treatment.

And the following one step may be added if required:

(9) a step of adding an external additive: to obtain the toner particles by adding an external additive to the dried colored particles.

Each of the above-described steps for producing a toner containing toner particles having a core shell structure will be described in the followings.

(1) Step of Preparing a Dispersion of Colorant Microparticles

In this step, a dispersion of colorant microparticles is prepared by adding a pigment used for a colorant into an aqueous medium and the mixture is dispersed with a homogenizer. More specifically, the dispersion treatment is carried out in an aqueous medium containing a surface active agent having a concentration exceeding a critical micelle concentration (CMC). Homogenizers employed for the dispersion process of colorant particles are not particularly limited but preferably employed are a pressure applying homogenizer such as an ultrasonic homogenizer, a mechanical homogenizer, a Manton-Gaulin homogenizer; or a pressure system homogenizer; as well as a medium type homogenizer such as a sand grinder, a Getzmann mill, or a diamond fine mill.

The dispersed size of the colorant microparticles in the dispersion of the colorant microparticles is preferably in the range of 4 to 200 nm measured with a median diameter.

(2-1) Step of Polymerizing Core Forming Binder Resin Microparticles

In this step, a dispersion of the binder resin microparticles composed of a core forming binder resin containing a releasing agent and a charge controlling agent is prepared by carrying out a polymerization treatment.

One of preferable examples of a polymerization treatment in this step is as follows. To an aqueous medium containing a surface active agent having a concentration less than a critical micelle concentration (CMC) is added a polymerizable monomer solution which contains, if necessary, a releasing agent and a charge controlling agent so as to obtain a mixture. Then, liquid droplets are formed by applying mechanical energy to the mixture, and further, a water soluble polymerization initiator is added to the mixture. Then, a water soluble polymerization initiator is added in order to perform a polymerization reaction in the aforesaid liquid droplets. Here, the aforesaid liquid droplets may contain an oil soluble polymerization initiator. In this step, it is indispensably required to carry out an enforced emulsifying (formation of liquid droplets) by applying mechanical energy. Examples of a device to apply mechanical energy include devices which give a strong stirring energy or a strong ultrasonic vibration energy such as: a homo mixer, an ultrasonic homogenizer and a Manton-Gaulin homogenizer.

[Surface Active Agent]

A surface active agent added in an aqueous medium used in the polymerization step of the aforesaid dispersion of colorant microparticles or core forming binder resin microparticles will be described.

Surface active agents employed in the polymerization method of the present invention are not particularly limited, but the ionic surface active agents listed below are preferred:

(a) sulfonic acid salts; sodium dodecylbenzenesulfonate and sodium arylalkylpolyether sulfonate (b) sulfuric acid ester salts; sodium dodecylsulfate, sodium tetradecylsulfate, sodium pentadecylsulfate and sodium octylsulfate (c) fatty acid salts; sodium oleate, sodium laurate, sodium caprate, sodium caprylate, sodium caproate, potassium stearate and calcium oleate.

Further, it is also possible to employ the nonionic surface active agents listed below: namely, polyethylene oxides, polypropylene oxides, combinations of polypropylene oxides and polyethylene oxides, esters of polyethylene glycol with higher fatty acids, alkylphenol polyethylene oxides, esters of higher fatty acid and polyethylene glycol, esters of higher fatty acid and polypropylene oxides and sorbitan esters.

A polymerization initiator, a chain transfer agent and a charge controlling agent employed in the step of polymerizing core forming binder resin microparticles in above-described (2-1) will be described.

[Polymerization Initiator]

Examples of the aforesaid water soluble polymerization initiator include: a persulfate salt such as potassium persulfate or ammonium persulfate; azobisaminodipropane acetic acid salts; azobiscyanovaleric acid and salts thereof; and hydrogen peroxide.

Examples of the aforesaid oil soluble polymerization initiator include:

(a) azo based or diazo based polymerization initiators; 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile (b) peroxide based polymerization initiators; benzoyl peroxide, methyl ethyl ketone peroxide, diisopropylperoxycarbonate, cumenehydroperoxide, t-butylhydroperoxide, di-t-butyl peroxide, dicumyl peroxide, 2,4-dichlorobenzoyl peroxide, lauroyl peroxide, 2,2-bis-(4,4-t-butylperoxycyclohexyl)propane, and tris-(t-butylperoxy)triazine, and (c) polymer polymerization initiators having a peroxide on the side chain.

[Chain Transfer Agent]

In this polymerization step, conventionally used chain transfer agents can be employed in order to regulate the molecular weight of the targeted core forming binder resin. A chain transfer agent used for the present invention is not specifically limited. Examples of a chain transfer agent include: a mercaptan such as n-octylmercaptan, n-decylmercaptan, or tert-dodecylmercaptan; a mercaptopropionic acid ester such as n-octyl-3-mercaptopropionic acid ester; terpinolene; and α-methylstyrene dimer.

[Charge Controlling Agent]

The toner particles used in the image forming method of the present invention may contain a charge controlling agent when required. A various type of publicly known charge controlling agents can be used as a charge controlling agent of the present invention.

In this step, it may be produced core forming binder microparticles containing a colorant. The core forming binder microparticles colored with a colorant are produced by polymerizing a composition of polymerizable monomers containing a colorant. When the core forming binder microparticles already colored with a colorant are used, the colored core particles can be produced by aggregating these colored core forming binder microparticles in the aggregation-fusion step described in (3), instead of carrying out the step of preparing a dispersion of colorant microparticles described in (1).

(2-2) Step of Polymerizing Shell Forming Resin

In this step, a dispersion of shell forming resin microparticles composed of a shell forming resin is prepared by carrying out a polymerization treatment in the same manner as the step of polymerizing core forming binder resin microparticles of (2-1).

(3) Step of Aggregation-Fusion

In this step, there are prepared associated particles which should form core particles by aggregating and fusing the core forming binder resin microparticles with the colorant microparticles in an aqueous medium. A preferable method of aggregation and fusion in this step is a salting out-fusion method in which are used the colorant microparticles prepared in the step of preparing a dispersion of colorant microparticles described in (1) and the core forming binder resin microparticles prepared in the step of polymerizing core forming binder resin microparticles described in (2-1).

Further, in the aforesaid aggregation and fusion process, it is possible to carry out aggregation and fusion by the addition of internal additive particles such as charge control agents together with the core forming binder resin microparticles and colorant microparticles.

Here, "salting out-fusion" indicates a process: to make proceed aggregation and fusion at the same time, and to stop the growth of particles by adding an aggregation preventing agent, and further, to apply heat so as to control the shape of the particles when required.

The salting out-fusion method is as follows: to add a salting out agent composed of an alkaline metal salt and an alkaline earth metal salt as an aggregating agent in an amount to reach at least the critical aggregation concentration into an aqueous medium in which the core forming binder resin microparticles and colorant particles exist; subsequently, heating is carried out to more than the glass transition temperature of the aforesaid core forming binder resin microparticles, at the same time to more than the melt peak temperature (° C.) of the core forming binder resin microparticles and the colorant microparticles, whereby salting out is proceeded, and aggregation and fusion are simultaneously carried out. Here, an alkaline metal salt and an alkaline earth metal salt used as a salting out agent include: an alkali metal such as lithium, potassium and Sodium; and an alkaline earth metal such as magnesium, calcium, strontium and barium. Among them, preferable are potassium, sodium, magnesium, calcium and barium.

When the aggregation-fusion process is carried out by the salting out-fusion method, the stand-still time after addition of a salting out agent is preferably as small as possible. The reason of this is not clear, but it was found that the aggregation state of the particles is changed by the stand-still time after a salting out treatment. It may produce problems such as causing an unstable particle size distribution or changing the surface property of the fused toner particles. Further, the temperature of the mixture to which a salting out agent is added is required to be less than the glass transition temperature of the core forming binder resin microparticles. The reason of this is as follows. When the temperature of adding a salting out agent is higher than the glass transition temperature of the core forming binder resin microparticles, the salting out-fusion of the core forming binder resin microparticles will proceed rapidly, but control of a particle size cannot be done. As a result, there may occur a problem of producing particles having a large size. The range of the addition temperature is required to be lower than the glass transition temperature of the resin. Generally, it is from 5 to 55° C., and preferably form 10 to 45° C.

Thus describe, the addition of a salting out agent is done at a lower temperature than the glass transition temperature the core forming binder resin microparticles. Then, the temperature is quickly increased to the point of above the glass transition temperature of the core forming binder resin microparticles, and at the same time, above the melt peak temperature (° C.) of the core forming binder resin microparticles and the colorant microparticles. The time to attain to this temperature is preferably within one hour. The increasing rate of the temperature should be large, it is preferably, larger than 0.25° C./minute. The upper limit of the increasing rate of the temperature is not determined, however, when it is too large, the salting out proceeds so quickly that the control of the particle size becomes hard to achieve. As a results, the maximum increasing rate of 5° C./minute is preferable. By applying the aforesaid salting out-fusion method, it can be produced a dispersion of the associated particles (core particles) which are formed via salting out and fusion of the core forming binder resin microparticles and any microparticles.

"An aqueous medium" indicates a medium composed of 50 to 100 weight % of water and 0 to 50 weight % of a water soluble organic solvent. Examples of a water soluble organic solvent include: methanol, ethanol, isopropanol, butanol, acetone, methyl ethyl ketone and tetrahydrofuran. Among them, an alcohol solvent which does not dissolve the produced resin is preferably used.

(4) First Ripening Step

In this step, a ripening treatment is performed so as to ripen the associated particles with heating energy. By controlling the heating temperature of the aggregation-fusion step, in particular by controlling the heating temperature and time of the first ripening step, it can be achieved to control the core particles having a narrow particle size distribution and a smooth and uniform particle surface. More specifically, the heating temperature is set to be low during the aggregation-fusion step so as to restrain the progress of the fusion between the core forming binder resin microparticles, which results in uniformity. By making the heating temperature in the first ripening step to be low and by making the time for application to be long, the surface of the core particles is controlled to be uniform.

(5) Shell Layer Forming Step

In the shell layer forming step, a dispersion of the shell forming resin microparticles is added in a dispersion of the core particles so as to aggregate and to fuse the shell forming resin microparticles on the surface of the core particles. By this process, a shell formation treatment is carried out in which the surface of the core particles are covered with the shell forming resin microparticles resulting in producing the particles having a core-shell structure.

This shell layer forming step is a preferable production condition to provide a low temperature fixing property and a thermo resisting storage property. Further, in order to achieve a high color reproduction property of a second color for forming an color image, this shell layer forming step is preferably applied.

More specifically, to a dispersion of the core particles kept in a condition of having the heating temperature of the aforesaid aggregation-fusion step and the first ripening step is added a dispersion of the shell forming resin microparticles. Then, the surface of the core particles slowly are covered with the shell forming resin microparticles with applying heat and stirring for several hours to form the particles having a core-shell structure. The time for applying heat and stirring is preferably from 1 to 7 hours, and more preferably it is from 3 to 5 hours.

(6) Second Ripening Step

When the particles having a core-shell structure are grown to have a predetermined particle size in the shell layer forming step, a terminating agent such as sodium chloride is added to stop the particle growth. Then heating and stirring are continued for further several hours in order to fuse the shell forming microparticles adhered on the core particles. The thickness of the layer formed by the shell forming microparticles covered on the surface of the core particles are made to be from 100 to 300 nm. Thus, the shell layer is formed by adhering the resin microparticles on the surface of the core particles. The colored particles having a round shape and uniform in size can be produced.

In the manufacturing method of the toner used in the present invention, it is possible to control the shape of the colored particles to become more spherical by setting the time of the second ripening step to be longer, or by setting the ripening temperature to be higher.

(7) Step of Filtering and Washing

In this step, the aforesaid dispersion of the colorant particles is subjecting to a cooling treatment. The condition of the cooling treatment is to cool preferably at a cooling rate of 1-20° C./min. The method of the cooling treatment, although it is not specifically limited, may include a method of cooling by introducing a cooling medium from outside of a reaction container and a method of cooling by directly charging cool water into the reaction system.

Then, from the dispersion of the colorant particles having been cooled down to a predetermined temperature, the colorant particles are separated using a solid-liquid separation treatment. A cleaning treatment is performed for removing deposits such as the surfactant and the salting-out agent from the toner cake (an aggregation substance with a cake-shape composed of wet colorant particles) obtained from the solid-liquid separation. Here, a filtration treatment method is not specifically limited, and the known methods such as the centrifugal separation method, vacuum filtration method using Nutsche and the filter method using a filter press are employed.

(8) Step of Drying

This step is a process of subjecting the toner cake having been subjected to the cleaning treatment to the dry treatment to obtain dried colorant particles. Listed as a dryer used in this process may be, for example, a spray dryer, a vacuum-freeze dryer, and a decompression dryer, and it may be used a stationary rack-dryer, a movable rack-dryer, a fluidized dryer, a rolling dryer, an agitation dryer and other dryers. The water content of the dried colorant particles is preferably 5% by weight or less, more preferably 2% by weight or less. When the colorant particles having been subjected to the dry treatment are agglomerated with a weak interparticle force among the particles, the agglomeration may be subjected to a powder treatment. Herein, mechanical type of powder machines such as a jet-mill, HENSCHEL MIXER, a coffee mill, a food processor may be used as the powder treatment machine.

(9) Step of Adding an External Additive

The colorant particles contained in the toner used in the image forming method of the present invention can constitute toner particles as they stand. However, it may possible to add so called an external additive so as to improve properties such as fluidity, charging property and cleaning property to produce to produce final toner particles. The external additive used in the present invention is not specifically limited, and a variety of inorganic microparticles or organic particles and aliphatic metal salts can be used.

Preferably used inorganic microparticles are inorganic oxide particles such as silica, titania and alumina. These inorganic microparticles are preferably subjected to a hydrophobic treatment with a silane coupling agent or a titanium coupling treatment.

As organic particles, particles having a number average primary particle size of 10 to 2,000 nm can be used. Examples of the organic particles include: polystyrene, poly(methyl methacrylate) and styrene-methyl methacrylate copolymer. A content of the external additive in the toner particles is from 0.1 to 5.0 weight % based on the total weight of the toner particles, and more preferably it is from 0.5 to 4.0 weight %. A plurality of different kinds of external additive may be jointly used.

[Image Support]

An image support usable in the image forming method of the present invention is not specifically limited if it is a recording medium which can hold a toner image.

Examples of an image support include: a plain paper such as a thin paper to a thick paper, a wood-free paper, an art paper, a printing paper of a coated paper, a commercial Japanese paper and a postcard printing paper, a plastic film for overhead projector, cloth and a PET sheet. The image support of the present invention is not limited to them.

[Developer]

The toner according to the present invention can be used a single component developer, or it can be used in a double component developer mixed with a carrier. When the toner is used in a double component developer, magnetic particles made of the known materials can be used as a carrier. Examples of the known material include: a metal such as iron, ferrite and magnetite; and an alloy made of the aforesaid metals and other metal such as aluminium or lead. In particular, ferrite particles are preferable. It can be used resin coated carriers which are coated with a coating material on the surface of the magnetic particles, or binder type carriers which are made by dispersing the magnetic particles in a binder resin. The coating resins which constitute the resin coated carrier are not specifically limited. Examples of the coating resins include: a polyolefin resin, a polystyrene resin, a styrene-acrylic copolymer resin, a silicone resin, a polyester resin and a fluorinated resin. The binder resins which constitute the binder type carrier are also not specifically limited. Examples of the binder resins include: a styrene-acrylic copolymer resin, a polyester resin, a fluorinated resin and a phenol resin.

The volume based median diameter of the carriers is preferably 20-100 μm, and more preferably it is 20-60 μm in order to obtain an image of high quality. The volume based median diameter of the carriers can be measured with, for example, "HELOS" (made by SYMPATEC Co. Ltd.), a particle size distribution measuring apparatus using a laser diffraction provided with a wet type dispersing device.

<Image Forming Method>

The image forming method of the present invention include at least the following processes:

(1) an electrostatic latent image forming process which forms electrostatic latent images on an electrostatic latent image carrier, (2) a development process which forms a toner image by developing electrostatic latent images formed on the electrostatic latent image carrier with a toner, (3) a transfer process which transfers toner images formed on the electrostatic latent image carrier onto an image support, (4) a color image forming process: repeating the processes (1) to (3) twice or more using a toner having a different color so as to obtain a color image, (5) a fixing process to fix the color toner image produced by a plurality of toners having a different color and transferred onto the image recording support.

The image forming method of the present invention can be performed using the image forming apparatus as described below.

[Image Forming Apparatus]

FIG. 1 is an illustrative cross sectional view showing one of the examples of an image forming apparatus used in the image forming method of the present invention.

This image forming apparatus is called as "a direct transfer full color image forming apparatus" without using an intermediate transfer body. It has a composition of 5 image forming units (18Y, 18M, 18C, 18G and 18Bk) which are located adjacent to transfer belt 15A.

The image forming units 18Y, 18M, 18C, 18G and 18Bk each are formed with an electric conductive layer and a photoconductive layer made of and an organic photoconductor (OPC) which is provided on the outer surface of a cylindrical base. This image forming apparatus is provided with photoreceptor drums (10Y, 10M, 10C, 10G and 10Bk) which are clockwise rotated in an earthed condition and are driven by the driving source (not illustrated), or they are moved together with the movement of transfer belt 15A. And, the image forming apparatus is provided with charging devices (11Y, 11M, 11C, 11G and 11Bk) located in an orthogonal position to the moving direction of the photoreceptor drums (10Y, 10M, 10C, 10G and 10Bk), and the charging devices give an uniform electric potential to the surface of the photoreceptor drums (10Y, 10M, 10C, 10G and 10Bk) with a corona discharge device giving the same polarity as the toner. An example of the charging device is a scorotron charging device. This image forming apparatus is provided with exposure devices (12Y, 12M, 12C, 12G and 12Bk), for example, made of a polygon mirror. The exposure devices perform scanning in the direction parallel to the rotation axe of the photoreceptor drums (10Y, 10M, 10C, 10G and 10Bk) so as to form a latent image on the surface of the photoreceptor drums (10Y, 10M, 10C, 10G and 10Bk) which have been uniformly charged based on the image data. Further, this image forming apparatus is provided with rotating developing sleeves (not illustrated). The toners held on the developing sleeves are transported to the surface of the photoreceptor drums (10Y, 10M, 10C, 10G and 18Bk) using developing devices (13Y, 13M, 13C, 13G and 13Bk).

In FIG. 1, 19Y, 19M, 19C, 19G and 19Bk are a cleaning device.

Here, a yellow toner image is formed by the image forming unit 18Y, a magenta toner image is formed by the image forming unit 18M, a cyan toner image is formed by the image forming unit 18C, a gray toner image is formed by the image forming unit 18G and a black toner image is formed by the image forming unit 18Bk.

Examples of a material used for the transfer belt 15A which transports image support P are: a polymer film such as polyimide, polycarbonate, or PVdF; a material composed of a synthetic rubber such as silicone rubber or a fluoro rubber added with an electro conductive filler. The transfer belt may be a drum or a belt, however, a belt is preferable from the viewpoint of getting flexibility of an apparatus design.

Moreover, the surface of the transfer belt 15A is preferably treated with moderate roughening. It is preferable, for example, to have a ten point surface roughness Rz of 0.5 to 2 μm. By making the surface of the transfer belt 15A to have the aforesaid roughness, close contact between the image support P and the transfer belt 15A can be increased. It is possible to prevent the vibration of the image support P on the transfer belt 15A, and as a result, transfer of the toner image from the photoreceptor drums ((10Y, 10M, 10C, 10G and 10Bk) to the image support P can be improved.

In the aforesaid image forming apparatus, each color toner image formed on the photoreceptor drums (10Y, 10M, 10C, 10G and 10Bk) of the image forming units (18Y, 18M, 18C, 18G and 18Bk) is successively transferred and superimposed on the image support P which is transported in synchronized timing by the transfer belt 15A with transfer devices (14Y, 14M, 14C, 14G and 14Bk). Thus a final color toner image is produced on the image support P.

The image support P having the color toner image on it is subjected to a process of removal of electricity with AC electricity removing device 15B located at a down stream position of the image transfer region of the image forming unit 18Bk on the transfer belt 15A. And further, the image support P having the color toner image on it is subjected to a separation process with separation nail 15C located at a position having a predetermined distance from transport portion 15D. After being subjected to these processes, the image support P is separated form the transfer belt 15A and is moved in the transport portion 15D. Then, the image support P is moved to fixing device 16 via the transport portion 15D.

In the fixing device 16, the image support P is held in nip N which is formed by heating roller 16*a* and pressure roller 16*b*. By applying heat and pressure to the image support P, the superimposed color toner image is fixed, and then, the image support P is discharged from the image forming apparatus.

The fixing temperature of the fixing device is preferably from 110 to 200° C., and it is more preferably from 120 to 160° C.

The image forming method of the present invention is not limited to the aforesaid method. It may be possible to use an image forming method using an intermediate transfer method. The formation of an image is carried out as follows: to form an electrostatic latent image of an electrostatic latent image carrier; to form a toner image by developing the electrostatic latent image with a toner; to transfer the formed toner image from the electrostatic latent image carrier to an intermediate transfer body; to transfer the formed toner image from the intermediate transfer body to an image support such as paper; then to fix the toner image on the image support to obtain a final fixed toner image.

In the image forming method of the present invention, the developing process performed by a light gray toner is preferably done prior to the developing process performed by a black toner. Further, in the fixed image formed on the image support, a light gray toner image is preferably developed in the order of superimposing on the upper side of a color toner image with respect to the image support.

More specifically, in the image forming method using an image forming apparatus adopting an intermediate transfer method, it is preferable to carry out the development in the following order: a light gray toner, a yellow toner, a cyan toner and a magenta toner. In the image forming method using an image forming apparatus adopting a direct transfer method as shown in FIG. 1, it is preferable to carry out the development in the following order: a yellow toner, a cyan toner, a magenta toner and a light gray toner.

By performing the developing processes having the order as described above, the degree of blackening of the underlying color image can be controlled by an adhering amount of a light gray toner and by an area ratio of overlapping of the color image with the light gray toner when the image is formed by superimposing the light gray toner on the color toner image.

By the image forming method thus describe, it is possible to form a high quality image of; showing only a small amount of difference of glossiness between a highlight portion and a shadow portion; exhibiting uniform and three-dimensional feeling. And further, it is possible to form an image excellent in granularity even when a soft tone image and a dull tone image are produced.

EXAMPLES

The present invention will now be specifically described with reference to examples, however the present invention is not limited to the following description.

<Preparation of Light Gray Toner 1>

[Preparation of Resin Particles A]

(First Step Polymerization)

In a 5 L reaction vessel fitted with a stirrer, a temperature sensor, a cooling pipe and a nitrogen introducing unit, was placed a solution prepared by dissolving 8 g of sodium dodecylsulfate in 3 L of ion-exchanged water. The aqueous surface active agent solution was stirred at a stirring rate of 230 rpm under a nitrogen gas atmosphere and it was heated to an inner temperature of 80° C. After elevating the temperature to 80° C., a solution prepared by dissolving 10 g of potassium persulfate in 200 ml of ion-exchanged water was added. Then again, the liquid temperature was increased to 80° C., and a monomer mixture solution composed of the compounds described below was dropped over one hour. Polymerization reaction was performed while stirring and heating at 80° C. for two hours to obtain resin particles (1H).

| | |
|---|---|
| Styrene | 480 g |
| n-Butyl acrylate | 250 g |
| Methacrylic acid | 68.0 g |
| n-Octyl-3-mercaptopropionate | 16.0 g |

(Second Step Polymerization)

In a 5 L reaction vessel fitted with a stirrer, a temperature sensor, a cooling pipe and a nitrogen introducing unit, was placed a solution prepared by dissolving 7 g of polyoxyethylene (2) sodium dodecyl ether sulfate in 800 ml of ion-exchanged water. After the liquid temperature was increased to 98° C., 260 g of the aforesaid resin particles [1H] and a monomer mixture solution prepared by dissolving the compounds described below at 90° C. was dropped. By using a mechanical dispersing device "CLEARMIX" (made by M Technique Corporation) provided with a circulating path, the mixture was mixed and dispersed over one hour to obtain a dispersion containing emulsified particles (oil droplets).

| | |
|---|---|
| Styrene | 245 g |
| n-Butyl acrylate | 120 g |
| n-Octyl-3-mercaptopropionate | 1.5 g |
| Paraffin wax A | 95 g |
| Ester wax A | 480 g |

Then, a polymerization initiator solution prepared by dissolving 6 g of potassium persulfate in 200 ml of ion-exchanged water was added. Then polymerization reaction was performed while stirring and heating the mixed system at 82° C. for one hour to obtain resin particles (1HM).

(Third Step Polymerization)

Further, a solution prepared by dissolving 11 g of potassium persulfate in 400 ml of ion-exchanged water was added. And a monomer mixture solution prepared by dissolving the compounds described below was dropped at a temperature condition of 82° C. over one hour.

| | |
|---|---|
| Styrene | 435 g |
| n-Butyl acrylate | 130 g |
| Methacrylic acid | 33 g |
| n-Octyl-3-mercaptopropionate | 8 g |

After completing the dropping, polymerization reaction was performed while stirring and heating the mixed system for two hours. Then the mixed system was cooled to 28° C. to obtain resin particles A.

[Preparation of Resin Particles B]

(First Step Polymerization)

In a 5 L reaction vessel fitted with a stirrer, a temperature sensor, a cooling pipe and a nitrogen introducing unit, was placed a solution prepared by dissolving 2.3 g of sodium dodecylsulfate in 3 L of ion-exchanged water. The aqueous surface active agent solution was stirred at a stirring rate of 230 rpm under a nitrogen gas atmosphere and it was heated to an inner temperature of 80° C. After elevating the temperature to 80° C., a solution prepared by dissolving 10 g of potassium persulfate in 200 ml of ion-exchanged water was added. Then again, the liquid temperature was increased to 80° C., and a monomer mixture solution composed of the compounds described below was dropped over one hour. Polymerization reaction was performed while stirring and heating at 80° C. for two hours to obtain resin particles B.

| | |
|---|---|
| Styrene | 520 g |
| n-Butyl acrylate | 210 g |
| Methacrylic acid | 68.0 g |
| n-Octyl-3-mercaptopropionate | 16.0 g |

[Preparation of a Colorant Dispersion]

A solution was prepared by dissolving 90 g of sodium dodecylsulfate in 1,600 ml of ion-exchanged water. With stirring this solution, 42 g of carbon black "Regal 330R" (made by Cabot Corporation) was slowly added to the solution as a colorant. Then the mixture was dispersed with a mechanical dispersing device "CLEARMIX" (made by M Technique Corporation) to obtain a dispersion of the colorant particles (hereafter, it is called as "colorant dispersion (1)"). The particle size of the colorant dispersion [1] was 110 nm it was measure with an electrophoretic light scattering photometer "ELS-800" (made by Otsuka Electronics CO. Ltd.).

[Aggregation and Fusion Process]

In a 5 L reaction vessel fitted with a stirrer, a temperature sensor, a cooling pipe and a nitrogen introducing unit, was placed a solution composed of the following compositions:

| | |
|---|---|
| Resin particles A | 300 g in solid content conversion, |
| Ion-exchanged water | 1.4 L |
| Colorant dispersion [1] | 120 g |

a solution prepared by dissolving 3 g of sodium polyoxyethylene (2) dodecyl ether sulfate in 120 ml of ion-exchanged water.

After adjusting the liquid temperature to be 30° C., a 5N aqueous sodium hydroxide solution was added to adjust the pH value to be 10. Then, an aqueous solution prepared by dissolving 35 g of magnesium chloride in 35 ml of ion-exchanged water was added at 30° C. with stirring for 10 minutes. After keeping the temperature for 3 minutes, the temperature of the mixture was gradually elevated to 90° C. for 60 minutes. The particle growth reaction was continued with keeping the temperature of 90° C. Subsequently, the average diameter of associated particles was determined via "COULTER MULTISIZER 3" (produced by Beckmann Coulter Co.), and when the volume based median diameter reached 3.1 μm, 260 g of the resin particles B was added and the particle growth reaction was further continued. When the volume based median diameter reached the required particle size, an aqueous solution prepared by dissolving 150 g of sodium chloride in 600 ml of ion-exchanged water was added, and particle growth was terminated. Further, the liquid temperature was regulated to 98° C., and fusion of the particles was allowed to proceed via heating and stirring as a fusion step to obtain particles having an average circularity of 0.965, which was determined employing "FPIA-2100" (produced by Sysmex Corp.) Then, the mixture was cooled to 30° C., and hydrochloric acid was added to adjust the pH to be 4.0 and stirring was stopped.

[Washing and Drying Process]

The particles prepared in the aforesaid aggregation and fusion process were introduced in a basket type centrifuge machine "MARK III, Type Number 60×40" (made by Matsumoto Kikai Co. Ltd.) to perform solid-liquid separation. A wet cake composed of toner mother particles was prepared. The obtained wet cake was washed with ion-exchanged water of 45° C. until the filtrate from the basket type centrifuge machine became to have an electro conductivity of 5 μS/cm. Then, the cake was transferred to "Flush Jet Dryer" (made by Seishin Co. Ltd.) and dried to the condition of the water content of less than 0.5 weight % and toner mother particles (1) were obtained.

[External Additive Addition Process]

To the toner mother particles (1) were added 1 weight % of hydrophobic silica (having a number average primary particle size of 12 nm) and 0.3 weight % of hydrophobic titania (having a number average primary particle size of 20 nm). Then the mixture was mixed with a Henschel mixer (produced by Mitsui Miike Mining Co., Ltd.) to obtain light gray toner (1) of the present invention. The softening point of the obtained light gray toner (1) was 110° C.

<Preparation of Light Gray Toners (2)-(9)>

Each of "light gray toners (2)-(9)" was prepared in the same manner as preparation of the aforesaid "light gray toner (1)", except that the colorant and the releasing agent were changed as listed in Table 1. Here, "light gray toners (2)-(5)" are the samples of the present invention, and "light gray toners (6)-(9)" are samples for comparison. The softening point of the light gray toners (2)-(9) was 110° C.

<Preparation of Light Gray Developers (1)-(9)>

Light gray developers (1)-(9) each were respectively prepared by the light gray toners (1)-(9) with a ferrite carrier coated with a silicone resin and having a volume based median diameter of 60 μm. The mixing was carried out with a V shape mixer in such a manner that a content of the light gray toner in each of the light gray developers (1)-(9) became 6 weight %.

<Preparation of Black Toner (1)>

Black toner (1) was prepared in the same manner as preparation of light gray toner (1), except that 1,680 g of "Regal 330R" (made by Cabot Corporation) was used as a colorant.

<Preparation of Yellow Toner (1)>

Yellow toner (1) was prepared in the same manner as preparation of light gray toner (1), except that 1,680 g of "C. I. Pigment Yellow 74" was used as a colorant.

<Preparation of Cyan Toner (1)>

Cyan toner (1) was prepared in the same manner as preparation of light gray toner (1), except that 1,600 g of a silicon phthalocyanine compound represented by the above-described Formula (1-2) was used as a colorant.

<Preparation of Magenta Toner (1)>

Magenta toner (1) was prepared in the same manner as preparation of light gray toner (1), except that 1,720 g of a compound represented by the above-described Formula (3-2) was used as a colorant.

<Preparation of Black Developer (1), Yellow Developer (1), Cyan Developer (1) and Magenta Developer (1)>

Black developer (1), yellow developer (1), cyan developer (1) and magenta developer (1) each were respectively prepared by the above-described black toner (1), yellow toner (1), cyan toner (1) and magenta toner (1) with a ferrite carrier coated with a silicone resin and having a volume based median diameter of 60 μm. The mixing was carried out with a V shape mixer in such a manner that a content of the color toner in each corresponding color developer became 6 weight %.

Inventive Examples 1-5 and Comparative Examples 6-9

Thus prepared light gray developers (1)-(9) each and black developer (1), yellow developer (1), cyan developer (1) and magenta developer (1) were examined to evaluate the following properties (1) and (2). The evaluation was performed using a digital multifunction peripheral "bizhub PRO C6500" (made by Konica Minolta Business Technologies, Inc.) with a modification of adding an image forming unit for a light gray toner. Each developer was loaded in each developing device which corresponds to each color and evaluated. The evaluation was carried out by setting the fixing temperature in the fixing process to be 180° C.

Further, in Table 1 are shown the transmittance values of the image portions produced by a light gray toner on a PET sheet with an adhered amount of the light gray toner of 4.0 g/m$^2$.

(1) Evaluation of Difference of Glossiness Between a Shadow Portion and a Highlight Portion An image having a highlight portion of a photographic image (a reflected light portion in a silver tableware) and an image having a high density black patch prepared as a reference were printed using a printer mode of bizhub PRO C6500. The glossiness values of the two images were compared, and the difference of glossiness was determined by the following relation ship. The evaluation was done according to the following criteria. Here, the image having a highlight portion of a photographic image was printed using a light gray toner, while the image having a high density black patch was printed using a black toner.

The glossiness was measure with a glossiness meter "PG-3G" (made by Nippon Denshoku Industries Co. Ltd.) with a incident angle of 75 degree. An average value obtained from 5 points (four corner points and a center point) was adopted as a glossiness value.

Relationship:

Difference of glossiness=(75 degree glossiness of an image having a high density black patch)−(75 degree glossiness of a one time fixed surface of an image having a photographic highlight image)

Evaluation Criteria

A: Difference of glossiness≦3

B: 3<Difference of glossiness≦6

C: 6<Difference of glossiness≦10

D: 10<Difference of glossiness (2-1) Evaluation of Granularity in Soft Tone Image A patch image composed of the following 8 soft tones in Web Safe Color was printed out using a printer mode of bizhub PRO C6500: #cc6666, #cc9966, #cccc66, #99cc66, #66cc66, #66cc9, #66cccc and #6699cc.

The granularity of each image using each toner set was evaluated as a whole. The criteria used for evaluation are as follows.

A: The obtained printed image has a fine texture by observing with a loupe of 10 times magnification, a uniform halftone image is reproduced.

B: The obtained printed image shows a small amount of roughness by observing with a loupe of 10 times magnification, but this small amount of roughness cannot be discernible by observing with the naked eye.

C: The obtained printed image shows a small amount of roughness by observing with the naked eye, but the amount of roughness can be admitted as an image.

D: The obtained printed image shows a large amount of roughness by observing with the naked eye, and the image gives a coarse texture.

(2-2) Evaluation of Granularity in Dull Tone Image

A patch image composed of the following 6 dull tones in Web Safe Color was printed out using a printer mode of bizhub PRO C6500: #996666, #999966, #669966, #669999, #666699 and #996699.

The granularity of each image using each toner set was evaluated as a whole. The criteria used for evaluation are as follows.

A: The obtained printed image has a fine texture by observing with a loupe of 10 times magnification, a uniform halftone image is reproduced.

B: The obtained printed image shows a small amount of roughness by observing with a loupe of 10 times magnification, but this small amount of roughness cannot be discernible by observing with the naked eye.

C: The obtained printed image shows a small amount of roughness by observing with the naked eye, but the amount of roughness can be admitted as an image.

D: The obtained printed image shows a large amount of roughness by observing with the naked eye, and the image gives a coarse texture.

In Table 1, "CB" represents "carbon black", "AB" represents "aniline black" and "$TiO_2$" is "titanium oxide".

Further, in Table 1, the melting point and the molecular weight of the wax contained in the releasing agent are as follows.

Paraffin wax A: melting point 65° C. and peak position of molecular weight 420

Paraffin wax B: melting point 105° C. and peak position of molecular weight 1,780

Paraffin wax C: melting point 75° C. and peak position of molecular weight 900

Ester wax A (stearyl palmitate): melting point 65° C. and peak position of molecular weight 480

Ester wax B (triacontanoic acid triacontanol ester): melting point 94° C. and peak position of molecular weight 790

The molecular eight of the aforesaid waxes were measured with a gel permutation chromatography using the following conditions.

Column: TSK gel G2000HXL×3 times (made by Tosoh Corporation) at 40° C.,

Eluant: THF, 1.0 ml/minute

Detection: RI

Calibration curve: standard polystyrene, n-hexylbenzene

TABLE 1

| | | Colorant | | Releasing agent | | | | Trans- | Evaluation | | |
|---|---|---|---|---|---|---|---|---|---|---|---|
| | Toner No. | Kind | Weight part | Kind of wax | Kind of wax | Mixing ratio | Endothermic peak (° C.) | mittance (%) | Difference of glossiness | Granularity of soft tone image | Granularity of dull tone image |
| Inv. 1 | **(1) | CB | 0.2 | Ester wax A | Paraffin wax A | 80:20 | 65 | 64 | B | B | B |
| Inv. 2 | **(2) | CB | 0.2 | Ester wax B | Paraffin wax C | 90:10 | 94 | 86 | B | B | B |
| Inv. 3 | **(3) | CB | 0.2 | Ester wax A | Paraffin wax B | 20:80 | 105 | 80 | A | A | A |
| Inv. 4 | **(4) | CB | 0.05 | Ester wax A | Paraffin wax B | 20:80 | 105 | 65 | A | A | B |
| Inv. 5 | **(5) | CB | 0.35 | Paraffin wax B | | — | 105 | 40 | B | B | B |
| Comp. 1 | **(6) | CB | 0.4 | Ester wax A | Paraffin wax B | 20:80 | 105 | 35 | B | D | D |
| Comp. 2 | **(7) | CB | 0.03 | Ester wax A | Paraffin wax B | 20:80 | 105 | 92 | B | D | D |
| Comp. 3 | **(8) | $TiO_2$ CB | 7 2 | Ester wax A | Paraffin wax B | 20:80 | 105 | 33 | D | D | D |
| Comp. 4 | **(9) | AB | 0.2 | Ester wax A | Paraffin wax B | 20:80 | 105 | 93 | D | D | D |

**Light gray toner,

Inv.: Inventive Examples,

Comp.: Comparative Examples

As is shown by the results listed in Table 1, Inventive Examples 1-5 prepared by using the image forming method of the present invention exhibited a small glossiness difference between a highlight portion and a shadow portion, and further, Inventive Examples 1-5 produced excellent granularity for a soft tone image and a dull tone image.

What is claimed is:

1. A method for forming an image with a set of electrostatic charge image developing toners using a digital electrophotographic method, provided that the set of electrostatic charge image developing toners comprises a black toner and a light gray toner, and the black toner and the light gray toner each comprise toner particles containing a binder resin, a colorant and a releasing agent, the method comprising the steps of:

forming an electrostatic latent image on an image support;

developing the electrostatic latent image with the black toner to form a black toner image;

developing the electrostatic latent image with the light gray toner to form a light gray toner image; and fixing the black toner image and the light gray toner image, wherein the black toner contains a wax having an endothermic peak in the range of 60 to 105° C.; and the light gray toner has a transmittance in the range of 40 to 90%, provided that the transmittance is measured for a fixed light gray toner image formed on a polyethyleneterephthalate sheet with an adhered amount of the light gray toner of 4.0 g/m$^2$, and the light gray toner contains a wax having an endothermic peak in the range of 60 to 105° C.

2. The method for forming an image of claim 1, wherein the step of developing the electrostatic latent image with the light gray toner is carried out before the step of developing the electrostatic latent image with the black toner.

3. The method for forming an image of claim 1, wherein each of the toners in the set of electrostatic charge image developing toners has a softening point of 70 to 120° C.

4. The method for forming an image of claim 1, further comprising the step of:

developing the electrostatic latent image with a color toner comprising at least one of a yellow toner, a cyan toper and a magenta toner, wherein the step of developing the electrostatic latent image with the light gray toner is carried out in a manner that an image formed with the light gray toner is provided on an image formed with the color toner on the image support.

5. The method for forming an image of claim 4, wherein the yellow toner contains C. I. Pigment Yellow 74 as a colorant.

6. The method for forming an image of claim 4, wherein the cyan toner contains a silicon phthalocyanine compound represented by Formula (1) as a colorant:

Formula (1)

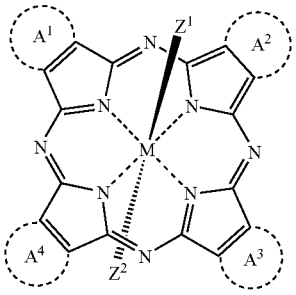

wherein M represents a silicon atom; $A^1$ to $A^4$ each independently represents a group of atoms which form a benzene ring or a group of atoms which form a benzene ring substituted with at least one of a chlorine atom, a nitro group, a cyano group and a perfluoro group; and $Z^1$ and $Z^2$ each independently represents a hydroxyl group, a chlorine atom, an aryloxy group having 6 to 18 carbon atoms, an alkoxy group having 1 to 22 carbon atoms or a group represented by Formula (2):

$$—O—Si(R^1)(R^2)(R^3) \quad \text{Formula (2)}$$

wherein $R^1$ to $R^3$ each independently represents an alkyl group having 1 to 6 carbon atoms, an aryl group having 6 to 18 carbon atoms, an alkoxy group having 1 to 6 carbon atoms or an aryloxy group having 6 to 18 carbon atoms.

7. The method for forming an image of claim 4, wherein the magenta toner comprises toner a compound represented by Formula (3) as a colorant:

Formula (3)

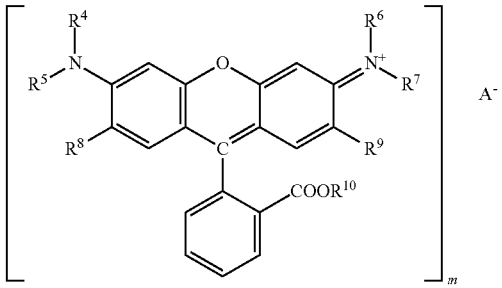

wherein $R^4$ to $R^{10}$ each independently represents a hydrogen atom or an alkyl group having 1 to 6 carbon atoms; $A^-$ represents a chlorine ion, a carboxylic acid ion having 1 to 22 carbon atoms or an atomic group represented by one of Formulas (4) to (6); and "m" represents an integer of 1 or 2:

Formula (4)

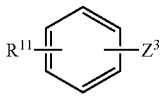

Formula (5)

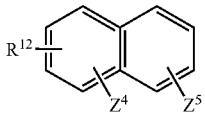

Formula (6)

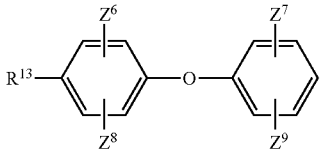

wherein $R^{11}$ to $R^{13}$ each independently represents an alkyl group having 1 to 20 carbon atoms; $Z^3$ represents a $—SO_3^-$ group, $Z^4$ and $Z^9$ each independently represents a hydrogen atom, an alkyl group or a $—SO_3^-$ group, provided that one of $Z^4$ and $Z^5$, and one of $Z^6$ to $Z^9$ represents a $—SO_3^-$ group.

* * * * *